US010233613B2

(12) United States Patent
Honda et al.

(10) Patent No.: US 10,233,613 B2
(45) Date of Patent: Mar. 19, 2019

(54) SHOVEL AND METHOD OF DRIVING SHOVEL

(71) Applicant: SUMITOMO HEAVY INDUSTRIES, LTD., Tokyo (JP)

(72) Inventors: Keiji Honda, Kanagawa (JP); Hiroshi Ishiyama, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/715,724

(22) Filed: Sep. 26, 2017

(65) Prior Publication Data

US 2018/0016770 A1 Jan. 18, 2018

Related U.S. Application Data

(63) Continuation of application No. PCT/JP2016/059516, filed on Mar. 24, 2016.

(30) Foreign Application Priority Data

Mar. 27, 2015 (JP) ..... 2015-067689

(51) Int. Cl.
*E02F 9/22* (2006.01)
*F15B 21/14* (2006.01)
*E02F 3/43* (2006.01)

(52) U.S. Cl.
CPC ..... *E02F 9/22* (2013.01); *E02F 3/43* (2013.01); *F15B 21/14* (2013.01)

(58) Field of Classification Search
CPC ... A01D 41/127; A01D 41/141; B60W 10/06; B60W 10/30; B60W 20/00; E02F 9/2075;
(Continued)

(56) References Cited

U.S. PATENT DOCUMENTS 6,708,787 B2 * 3/2004 Naruse ..... B60K 6/12 180/53.8
7,472,009 B2 * 12/2008 Baldwin ..... E02F 3/48 172/4.5
7,565,801 B2 * 7/2009 Tozawa ..... E02F 9/2075 60/414
7,797,934 B2 * 9/2010 Bacon ..... E02F 9/226 60/431
(Continued)

FOREIGN PATENT DOCUMENTS

JP S63-067403 3/1988
JP H05-027303 U 4/1993
(Continued)

OTHER PUBLICATIONS

International Search Report for PCT/JP2016/059516 dated Jun. 28, 2016.

*Primary Examiner* — Robert E Pezzuto
(74) *Attorney, Agent, or Firm* — IPUSA, PLLC

(57) ABSTRACT

A shovel includes a swing hydraulic motor configured to swing a rotating structure, a swing drive hydraulic circuit configured to drive the swing hydraulic motor, an assist hydraulic motor connected to an engine and configured to be supplied with hydraulic oil discharged from the swing drive hydraulic circuit, and a controller configured to control the driving of the shovel. The controller is configured to detect the load condition of the engine, and control the supply of the hydraulic oil to the assist hydraulic motor at the time of deceleration of the swing hydraulic motor, based on the detected load condition.

11 Claims, 8 Drawing Sheets

(58) Field of Classification Search
CPC ..... E02F 9/226; E02F 9/2025; E02F 9/2225; E02F 9/2228; E02F 9/128; E02F 9/2066; E02F 9/2217; E02F 9/2285; E02F 9/2289; E02F 9/123; E02F 9/2235; E02F 9/2296; E02F 9/2242; E02F 9/22; E02F 3/43; F15B 1/024; F15B 1/027; F15B 11/08; F15B 11/17; F15B 11/055; F15B 21/14
USPC .... 37/348, 414; 60/452, 468, 459, 377, 484; 172/4.5, 5, 132, 234; 180/53.6, 53.7, 180/53.8; 417/212, 213, 218, 221, 270; 701/49, 50, 73, 117
See application file for complete search history.

(56) References Cited

U.S. PATENT DOCUMENTS

| | | | | |
|---|---|---|---|---|
| 7,904,224 | B2 * | 3/2011 | Kanayama | E02F 9/2025 172/132 |
| 9,022,749 | B2 * | 5/2015 | Akiyama | E02F 9/123 417/212 |
| 9,067,586 | B2 * | 6/2015 | Kawashima | B60W 10/06 |
| 10,000,906 | B2 * | 6/2018 | Wu | F15B 21/14 |
| 10,024,341 | B2 * | 7/2018 | Zhang | E02F 9/128 |
| 2016/0002889 | A1 | 1/2016 | Kajita et al. | |

FOREIGN PATENT DOCUMENTS

| | | |
|---|---|---|
| JP | 2008-075753 | 4/2008 |
| JP | 2012-077458 | 4/2012 |
| JP | 2013-124736 | 6/2013 |
| JP | 2014-145387 | 8/2014 |

* cited by examiner

SHOVEL AND METHOD OF DRIVING SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2016/059516, filed on Mar. 24, 2016 and designating the U.S., which claims priority to Japanese Patent Application No. 2015-067689, filed on Mar. 27, 2015. The entire contents of the foregoing applications are incorporated herein by reference.

BACKGROUND

Technical Field

The present invention relates to shovels configured to have a swing mechanism driven by a hydraulic motor, and methods of driving a shovel.

Description of Related Art

A hydraulic motor configured to drive the swing mechanism of a shovel is driven with high-pressure hydraulic oil supplied from a hydraulic pump through a motor drive hydraulic circuit. The motor drive hydraulic circuit includes a pair of main conduits, namely, a conduit in which hydraulic oil supplied to the hydraulic motor flows and a conduit in which hydraulic oil discharged from the hydraulic motor flows. When one of the main conduits serves as a supply conduit, the other of the main conduits serves as a discharge conduit. To reverse the rotation direction of the hydraulic motor, the supply conduit and the discharge conduit are switched.

To stop the swinging of the rotating structure of the shovel, both of the main conduits of the motor drive hydraulic circuit are closed to stop the driving of the hydraulic motor. The rotating structure of the shovel, however, has a large inertia weight and cannot stop instantaneously. Therefore, even when the supply conduit is closed, the hydraulic motor tries to keep rotating because of the inertial force of the rotating structure.

With this, hydraulic oil discharged from the hydraulic motor flows into the closed discharge conduit to sharply increase the hydraulic pressure inside the discharge conduit. This increase in the hydraulic pressure inside the discharge conduit brakes the hydraulic motor, but an excessive increase in the hydraulic pressure may damage the discharge conduit. Therefore, a relief valve is provided in the discharge conduit to prevent the hydraulic pressure inside the discharge conduit from exceeding a predetermined pressure (a relief pressure), thereby preventing damage to the discharge conduit due to high pressure.

The hydraulic pressure of a discharge conduit is returned to a supply conduit through a variable relief valve according to a related-art motor drive hydraulic circuit, while hydraulic oil in the discharge conduit may be returned to a hydraulic oil tank through a relief valve.

SUMMARY

According to an aspect of the present invention, a shovel includes a swing hydraulic motor configured to swing a rotating structure, a swing drive hydraulic circuit configured to drive the swing hydraulic motor, an assist hydraulic motor connected to an engine and configured to be supplied with hydraulic oil discharged from the swing drive hydraulic circuit, and a controller configured to control the driving of the shovel. The controller is configured to detect the load condition of the engine, and control the supply of the hydraulic oil to the assist hydraulic motor at the time of deceleration of the swing hydraulic motor, based on the detected load condition.

According to an aspect of the present invention, a method of driving a shovel, the shovel including a swing hydraulic motor configured to swing a rotating structure, a swing drive hydraulic circuit configured to drive the swing hydraulic motor, an assist hydraulic motor connected to an engine and configured to be supplied with hydraulic oil discharged from the swing drive hydraulic circuit, and a controller configured to control the driving of the shovel, includes detecting the load condition of the engine and controlling the supply of the hydraulic oil to the assist hydraulic motor at the time of deceleration of the swing hydraulic motor, based on the detected load condition.

DETAILED DESCRIPTION

In the case of letting hydraulic pressure escape from a discharge conduit by providing a relief valve in a main conduit of the motor drive hydraulic circuit, high-pressure hydraulic oil is discharged, thus wasting energy accumulated in the hydraulic oil as pressure.

According to an aspect of the present invention, a shovel in which the driving of an engine can be assisted by driving an assist hydraulic motor with high-pressure hydraulic oil discharged from a motor drive hydraulic circuit and the over-rotation of the assist hydraulic motor can be prevented is provided.

According to an aspect of the present invention, the flow rate of hydraulic oil supplied to an assist hydraulic motor is controlled while monitoring the load condition of an engine. Therefore, the over-rotation of the assist hydraulic motor is prevented, and the driving of the engine can be properly assisted.

Embodiments of the present invention are described with reference to the drawings.

Figure 1:
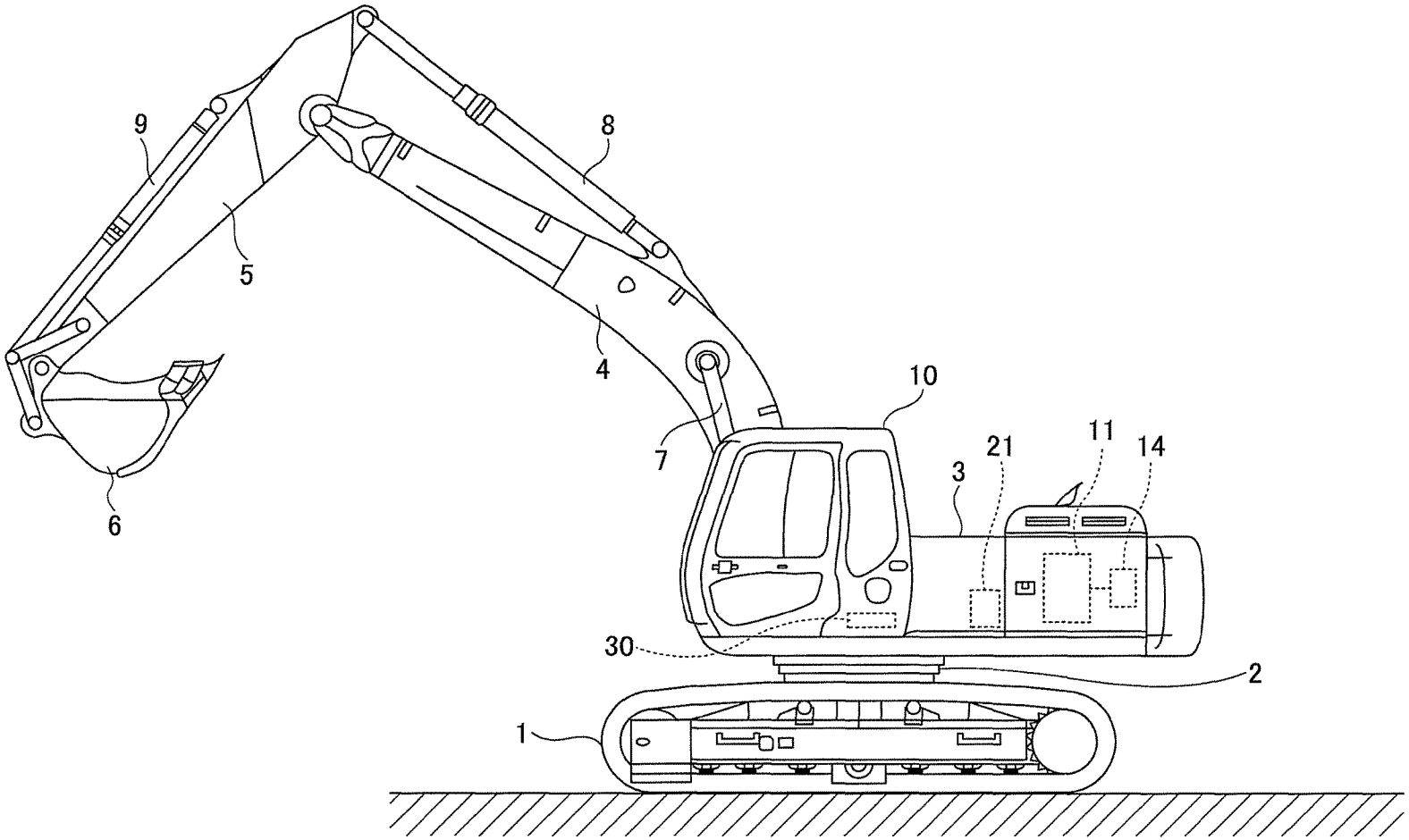
FIG. 1 is a side view of a shovel according to an embodiment of the present invention.

FIG. 1 is a side view of a shovel according to an embodiment. An upper rotating structure 3 is mounted on an undercarriage 1 of the shovel via a swing mechanism 2. A boom 4 is attached to the upper rotating structure 3. An arm 5 is attached to an end of the boom 4. A bucket 6 serving as an end attachment is attached to an end of the arm 5. Alternatively, a slope bucket, a dredging bucket, a breaker or the like may be used as an end attachment.

The boom 4, the am 5, and the bucket 6 form an excavation attachment as an example of an attachment, and are hydraulically driven by a boom cylinder 7, an arm cylinder 8, and a bucket cylinder 9, respectively.

On the upper rotating structure 3, a cabin 10 is provided, and power sources such as an engine 11 and a main pump 14 (hydraulic pump) driven by the engine 11 are mounted. Furthermore, a swing hydraulic motor 21 for driving the above-described swing mechanism 2 to swing the upper rotating structure 3 is provided on the upper rotating structure 3. In addition, a hydraulic circuit (not depicted) for driving the swing hydraulic motor 21, the boom cylinder 7, the am cylinder 8, the bucket cylinder 9, etc., is provided on the upper rotating structure 3.

A controller 30 is provided in the cabin 10 as a main control part for controlling the driving of the shovel. According to this embodiment, the controller 30 is composed of a processing unit including a CPU and an internal memory. The CPU executes a program stored in the internal memory to implement various functions of the controller 30.

Figure 2:
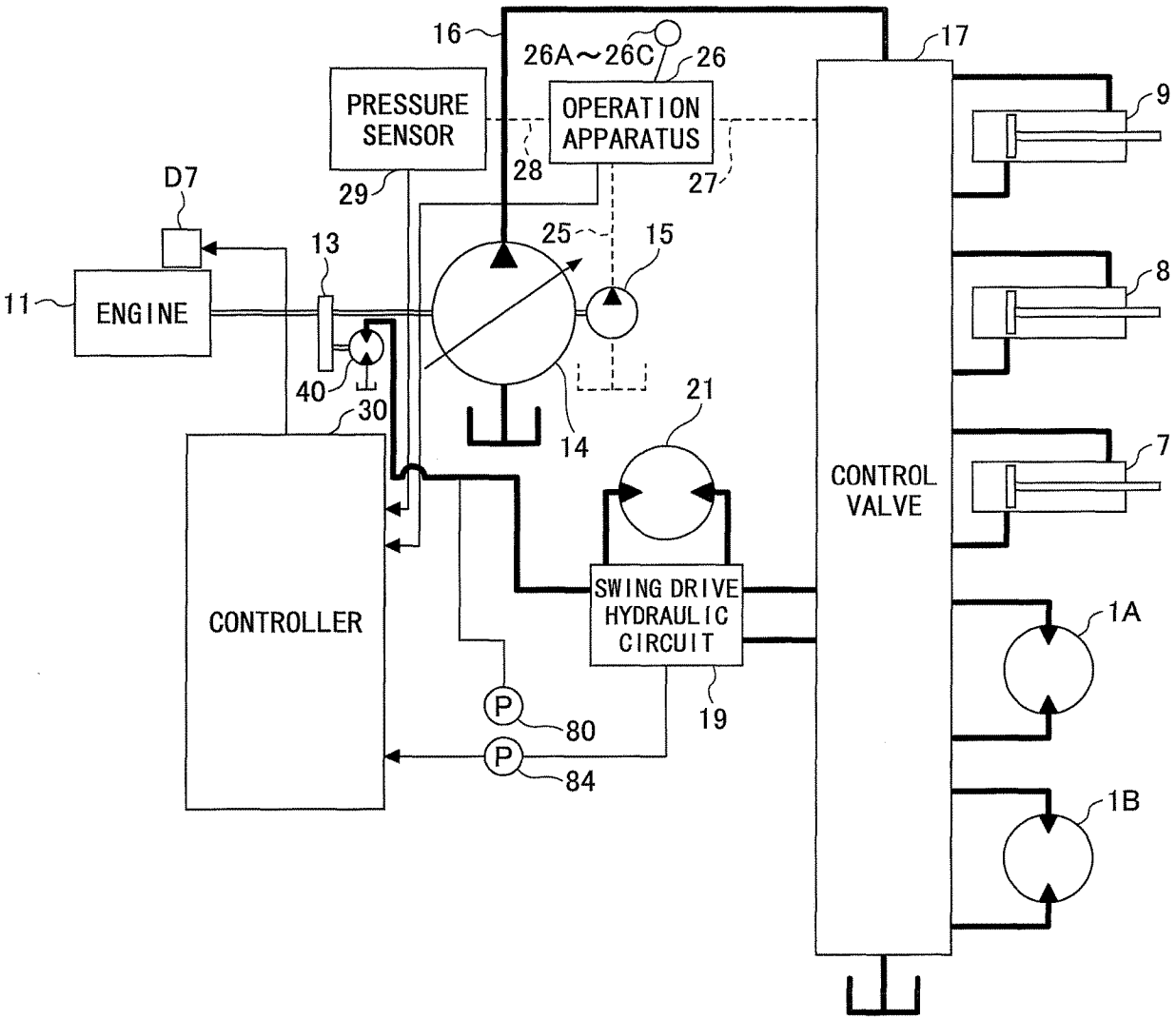
FIG. 2 is a configuration diagram of a drive system of the shovel.

FIG. 2 is a block diagram illustrating a configuration of the drive system of the shovel of FIG. 1. In FIG. 2, a mechanical power system, a high-pressure hydraulic line, a pilot line, and an electric drive and control system are indicated by a double line, a thick solid line, a dashed line, and a thin solid line, respectively.

The engine 11 is a power source of the shovel. According to this embodiment, the engine 11 is a diesel engine adopting isochronous control that keeps the rotational speed of the engine constant irrespective of an increase or decrease in a load on the engine. The amount of fuel injection, the timing of fuel injection, boost pressure, etc., in the engine 11 are controlled by an engine control unit D7.

The engine control unit D7 is a device that controls the engine 11. According to this embodiment, the engine control unit D7 executes various functions such as an automatic idling function and an automatic idling stop function.

The main pump 14 and a pilot pump 15 serving as hydraulic pumps are connected to the output shaft of the engine 11 through a transmission 13. A control valve 17 is connected to the main pump 14 via a high-pressure hydraulic line 16. Furthermore, an assist hydraulic motor 40 as well is connected to the output shaft of the engine 11 through the transmission 13.

The control valve 17 is a hydraulic control device that controls the hydraulic system of the shovel. Hydraulic actuators such as a right-side traveling hydraulic motor 1A, a left-side traveling hydraulic motor 1B, the boom cylinder 7, the arm cylinder 8, and the bucket cylinder 9 are connected to the control valve 17 through high-pressure hydraulic lines. Furthermore, the swing hydraulic motor 21 is connected to the control valve 17 via a swing drive hydraulic circuit 19.

An operation apparatus 26 is connected to the pilot pump 15 through a pilot line 25.

The operation apparatus 26 includes a lever 26A, a lever 26B, and a pedal 26C. According to this embodiment, the operation apparatus 26 is connected to the control valve 17 through a hydraulic line 27. Furthermore, the operation apparatus 26 is connected to a pressure sensor 29 through a hydraulic line 28.

The pressure sensor 29 detects the operations of the lever 26A, the lever 26B, and the pedal 26C of the operation apparatus 26 as changes in pilot pressure. The pressure sensor 29 outputs pressure detection values to the controller 30.

In addition to the above-described arrangement, according to this embodiment, the assist hydraulic motor 40 that assists the engine 11 is provided. Hydraulic oil discharged from hydraulic actuators including the swing hydraulic motor 21 is supplied to the assist hydraulic motor 40 through the swing drive hydraulic circuit 19 to drive the assist hydraulic motor 40. It is possible to assist the driving of the engine 11 by driving the assist hydraulic motor 40. That is, by reusing the energy of hydraulic oil discharged from the swing hydraulic motor 21 as a driving force for the engine 11, the amount of fuel consumption of the engine 11 is reduced, thus contributing to the energy conservation of the shovel.

Figure 3:
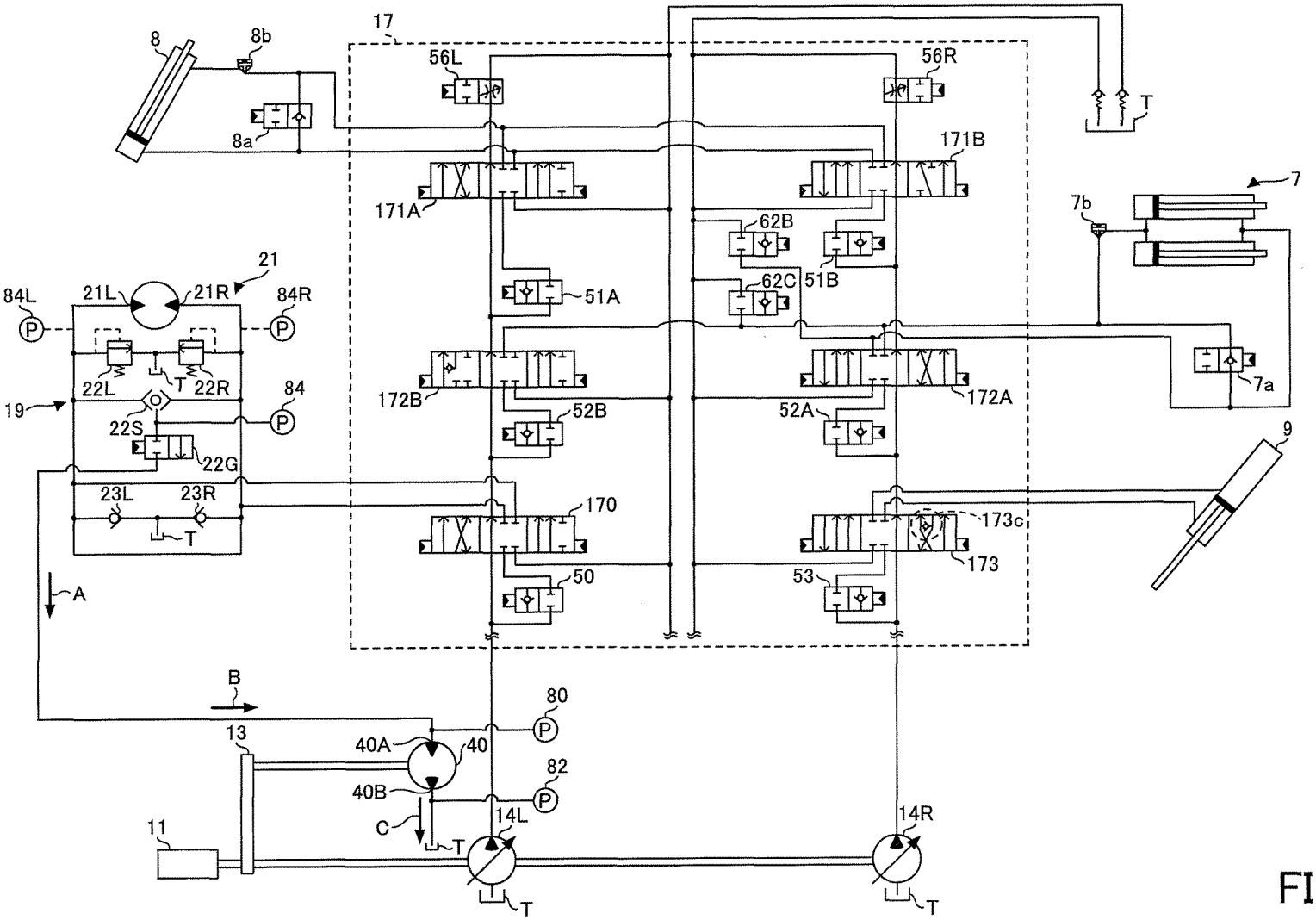
FIG. 3 is a circuit diagram of a tandem hydraulic circuit.

Next, a tandem hydraulic circuit, which is an example of a hydraulic circuit according to this embodiment, is described with reference to FIG. 3. FIG. 3 is a circuit diagram of the tandem hydraulic circuit.

The tandem hydraulic circuit shown in FIG. 3 includes a first pump 14L, a second pump 14R, the control valve 17, and various hydraulic actuators. The hydraulic actuators include the boom cylinder 7, the aim cylinder 8, the bucket cylinder 9, the swing hydraulic motor 21, and the assist hydraulic motor 40.

The boom cylinder 7 is a hydraulic cylinder that raises and lowers the boom 4. A regeneration valve 7*a* is connected between the bottom-side oil chamber and the rod-side oil chamber of the boom cylinder 7, and a holding valve 7*b* is placed on the bottom-side oil chamber side. The arm cylinder 8 is a hydraulic cylinder that opens and closes the arm 5. A regeneration valve 8*a* is connected between the bottom-side oil chamber and the rod-side oil chamber of the arm cylinder 8, and a holding valve 8*b* is placed on the rod-side oil chamber side. The bucket cylinder 9 is a hydraulic cylinder that opens and closes the bucket 6.

The first pump 14L is a hydraulic pump that draws in hydraulic oil from a hydraulic oil tank T and discharges the hydraulic oil, and is a swash-plate variable displacement hydraulic pump according to this embodiment. The first pump 14L is connected to a regulator (not depicted). The regulator changes the swash plate tilt angle of the first pump 14L in accordance with a command from the controller 30 to control the discharge quantity of the first pump 14L. The same is the case with the second pump 14R.

The assist hydraulic motor 40 is a fixed displacement hydraulic motor according to this embodiment. The assist hydraulic motor 40 is connected to the swing drive hydraulic circuit 19 of the swing hydraulic motor 21, and is driven with high-pressure hydraulic oil discharged from the swing drive hydraulic circuit 19.

According to this embodiment, the first pump 14L, the second pump 14R, and the assist hydraulic motor 40 have their respective drive shafts mechanically coupled. Specifically, the drive shafts of the first pump 14L, the second pump 14R, and the assist hydraulic motor 40 are coupled to the output shaft of the engine 11 at predetermined gear ratios via the transmission 13. Therefore, when the engine rotational speed is constant, the rotational speeds of the first pump 14L, the second pump 14R, and the assist hydraulic motor 40 are also constant. Alternatively, the first pump 14L, the second pump 14R, and the assist hydraulic motor 40 may be connected to the engine 11 via a continuously variable transmission or the like to be able to change their rotational speeds even when the engine rotational speed is constant.

The control valve 17 is a hydraulic control device that controls the hydraulic system of the shovel. The control valve 17 includes variable load check valves 50, 51A, 51B, 52A, 52B and 53, integrated bleed-off valves 56L and 56R, selector valves 62B and 62C, and flow control valves 170, 171A, 171B, 172A, 172B and 173.

The flow control valves 171A and 171B are valves that control the direction and flow rate of hydraulic oil flowing into and out of the arm cylinder 8. Specifically, the flow control valve 171A is configured to supply the arm cylinder 8 with hydraulic oil discharged by the first pump 14L (hereinafter referred to as "first hydraulic oil"), and the flow control valve 171B is configured to supply the arm cylinder 8 with hydraulic oil discharged by the second pump 14R (hereinafter referred to as "second hydraulic oil"). Accordingly, the first hydraulic oil and the second hydraulic oil can simultaneously flow into the arm cylinder 8.

The flow control valve 172A is a valve that controls the direction and flow rate of hydraulic oil flowing into and out of the boom cylinder 7. The flow control valve 172B is a valve that causes the first hydraulic oil to flow into the bottom-side oil chamber of the boom cylinder 7 in response to execution of a boom raising operation. The flow control valve 172B can merge hydraulic oil flowing out of the bottom-side oil chamber of the boom cylinder 7 with the first hydraulic oil in response to execution of a boom lowering operation.

The flow control valve 173 is a valve that controls the direction and flow rate of hydraulic oil flowing into and out of the bucket cylinder 9. The flow control valve 173 contains a check valve 173*c* for reusing hydraulic oil flowing out of the rod-side oil chamber of the bucket cylinder 9 for the bottom-side oil chamber.

The flow control valve 170 is configured to supply hydraulic oil discharged by the first pump 14L to the swing drive hydraulic circuit 19 for driving the swing hydraulic motor 21.

The variable load check valves 50, 51A, 51B, 52A, 52B and 53 are two-port, two-position valves that can switch connection and disconnection between the flow control valves 170, 171A, 171B, 172A, 172B and 173, respectively, and at least one of the first pump 14L and the second pump 14R. These six variable load check valves operate in conjunction with one another to serve as a merging switching part.

The integrated bleed-off valves 56L and 56R are valves that operate in response to a command from the controller 30. According to this embodiment, the integrated bleed-off valve 56L is a two-port, two-position solenoid valve that can control the amount of the first hydraulic oil discharged to the hydraulic oil tank T. The same is the case with the integrated bleed-off valve 56R. According to this configuration, the integrated bleed-off valves 56L and 56R can reproduce the composite opening of related flow control valves among the flow control valves 170, 171A, 171B, 172A, 172B and 173. Specifically, the integrated bleed-off valve 56L can reproduce the composite opening of the flow control valves 170, 171A and 172B, and the integrated bleed-off valve 56R can reproduce the composite opening of the flow control valves 171B, 172A and 173.

Each of the flow control valves 170, 171A, 171B, 172A, 172B and 173 is a six-port, three-position spool valve, and includes center bypass ports. Therefore, the integrated bleed-off valve 56L is placed on the downstream side of the flow control valve 171A, and the integrated bleed-off valve 56R is placed on the downstream side of the flow control valve 171B.

The variable load check valves 50, 51A, 51B, 52A, 52B and 53 are valves that operate in response to a command from the controller 30. According to this embodiment, the variable load check valves 50, 51A, 518, 52A, 52B and 53 are two-port, two-position solenoid valves that can switch connection and disconnection between the flow control valves 170, 171A, 171B, 172A, 172B and 173, respectively, and one of the first pump 14L and the second pump 14R. Each of the variable load check valves 50, 51A, 51B, 52A, 52B and 53 includes a check valve that interrupts the flow of hydraulic oil returning to the pump side at a first position. Specifically, the variable load check valves 51A and 51B cause the flow control valves 171A and 171B to communicate with the first pump 14L and the second pump 14R, respectively, when their check valves are at the first position, and to interrupt the communication when their check valves are at a second position. The same is the case with the variable load check valves 52A and 52B and with the variable load check valves 50 and 53.

The swing hydraulic motor 21 is a hydraulic motor that swings the upper rotating structure 3. Ports 21L and 21R of the swing hydraulic motor 21 are connected to the hydraulic oil tank T via relief valves 22L and 22R, respectively, and are connected to a regeneration valve 22G via a shuttle valve 22S. Furthermore, the ports 21L and 21R of the swing hydraulic motor 21 are connected to a supply port 40A of the assist hydraulic motor 40 via the shuttle valve 22S and the regeneration valve 22G.

An assist supply-side pressure sensor 80 is connected to a predetermined point near the assist hydraulic motor 40 on a conduit that connects the regeneration valve 22G and the supply port 40A of the assist hydraulic motor 40. The assist supply-side pressure sensor 80 detects the pressure of hydraulic oil flowing into the assist hydraulic motor 40 to provide a detection signal to the controller 30.

A discharge port 40B of the assist hydraulic motor 40 is connected to the hydraulic oil tank T. An assist discharge-side pressure sensor 82 is connected to a predetermined point near the discharge port 40B on a conduit that is connected from the discharge port 40B to the hydraulic oil tank T. The assist discharge-side pressure sensor 82 detects the pressure of hydraulic oil discharged from the assist hydraulic motor 40 to provide a detection signal to the controller 30. The assist discharge-side pressure sensor 82 does not necessarily have to be provided when the pressure of hydraulic oil discharged from the assist hydraulic motor 40 is regarded as equal to atmospheric pressure.

The relief valve 22L opens to discharge hydraulic oil on the port 21L side to the hydraulic oil tank T when the pressure on the port 21L side reaches a predetermined relief pressure. Likewise, the relief valve 22R opens to discharge hydraulic oil on the port 21R side to the hydraulic oil tank T when the pressure on the port 21R side reaches a predetermined relief pressure.

The shuttle valve 22S supplies hydraulic oil on one of the port 21L side and the port 21R side on which the pressure is higher to the regeneration valve 22G. The regeneration valve 22G is an on-off valve that operates in response to a command from the controller 30, and switches connection and disconnection between the swing hydraulic motor 21 (the shuttle valve 22S) and the assist hydraulic motor 40.

When the regeneration valve 22G opens, hydraulic oil on one of the port 21L side and the port 21R side on which the pressure is higher is supplied to the supply port 40A of the assist hydraulic motor 40 to drive the assist hydraulic motor 40.

A check valve 23L opens to supply hydraulic oil stored in the hydraulic oil tank T to the port 21L side of the swing hydraulic motor 21 when the pressure on the port 21L side becomes a negative pressure. A check valve 23R opens to supply hydraulic oil stored in the hydraulic oil tank T to the port 21R side of the swing hydraulic motor 21 when the pressure on the port 21R side becomes a negative pressure. Thus, the check valves 23L and 23R form a supply mechanism that supplies hydraulic oil to the intake-side port when braking the swing hydraulic motor 21.

The tandem hydraulic circuit as described above makes it possible to supply high-pressure hydraulic oil generated at the port 21L or the port 21R when braking the swing hydraulic motor 21 to the assist hydraulic motor 40 to drive the assist hydraulic motor 40. The assist hydraulic motor 40 is driven to assist the driving of the engine 11, for which the amount of engine fuel consumption is reduced.

Next, a flow of hydraulic oil at the time of the driving of the assist hydraulic motor 40 is described with reference to FIG. 3.

Here, a description is given of the case where the swing operation lever 26A is returned to a neutral position to stop the swinging of the upper rotating structure 3 while the swinging is performed with hydraulic oil being supplied to the port 21L of the swing hydraulic motor 21.

When the swing operation lever 26A is returned to a neutral position, the pressure sensor 29 detects this to transmit a signal to the controller 30. In response to the reception of this signal, the controller 30 transmits a control signal to the flow control valve 170 to switch the position of the flow control valve 170 to interrupt the supply of hydraulic oil from the first pump 14L to the swing drive hydraulic circuit 19.

Then, the supply of hydraulic oil to the port 21L of the swing hydraulic motor 21 is stopped. The swing hydraulic motor 21, however, tries to keep rotating because of the inertial force of the upper rotating structure 3. The rotation of the swing hydraulic motor 21 reduces the pressure of the hydraulic oil on the port 21L side and increases the pressure of the hydraulic oil on the port 21R side.

At this point, the check valve 23L opens so that hydraulic oil is suctioned from the hydraulic oil tank T by a negative pressure to flow in to the port 21L side. As a result, the swing hydraulic motor 21 becomes able to rotate with inertia without having a large negative pressure on the port 21L side.

When the swing hydraulic motor 21 thus continues to rotate with inertia, the pressure of hydraulic oil on the port 21R side of the swing hydraulic motor 21 increases to the relief pressure of the relief valve 22R. The pressure generated in the hydraulic oil on the port 21R side at this point works as a brake force to prevent the rotation of the swing hydraulic motor 21.

When a swing discharge-side pressure sensor 84 connected to the upstream side of the regeneration valve 22G detects that the pressure of hydraulic oil on the port 21R side has become the relief pressure, the controller 30 transmits a control signal to the regeneration valve 22G to open the regeneration valve 22G. As a result, the high-pressure hydraulic oil on the port 21R side flows through the regeneration valve 22G like arrows A and B to be supplied to the supply port 40A of the assist hydraulic motor 40. Accordingly, the assist hydraulic motor 40 can be driven with the high-pressure hydraulic oil on the port 21R side generated by the inertial rotation of the swing hydraulic motor 21 to assist the driving of the engine 11.

The hydraulic oil reduced in pressure by driving the assist hydraulic motor 40 is discharged from the discharge port 40B to flow like an arrow C to return to the hydraulic oil tank T.

While the hydraulic oil thus flows from the swing hydraulic motor 21 to the assist hydraulic motor 40 to drive the assist hydraulic motor 40, the controller 30 monitors the load condition of the engine 11. Specifically, the controller 30 can estimate the load condition of the engine 11 from, for example, the amount of fuel injection of the engine 11 transmitted from the engine control unit D7. Alternatively, the controller 30 can estimate the load condition of the engine 11 from the outputs (discharge pressures and discharge flow rates) of the first and second pumps 14L and 14R.

Then, the controller 30 determines a target torque for the assist hydraulic motor 40 corresponding to the load condition of the engine 11 (which corresponds to the torque of the engine 11). Next, the controller 30 determines the differential pressure between the detected pressure of the assist supply-side pressure sensor 80 and the detected pressure of the assist discharge-side pressure sensor 82. Then, the controller 30 calculates the output torque of the assist hydraulic motor 40 from the determined differential pressure, and compares the calculated output torque with the determined target torque. The output torque may be calculated only from the detected pressure of the assist supply-side pressure sensor 80 when the pressure of the hydraulic oil discharged from the assist hydraulic motor 40 is regarded as equal to atmospheric pressure.

When the calculated output torque is less than or equal to the target torque, the controller 30 leaves the regeneration valve 22G open to continue assisting by the driving of the assist hydraulic motor 40. When the calculated output torque exceeds the target torque, the controller 30 closes the regeneration valve 22G to stop driving the assist hydraulic motor 40 to stop assisting the engine 11. As a result, the engine 11 is prevented from rotating excessively and is properly assisted.

That is, when the output torque of the assist hydraulic motor 40 exceeds the target torque, the engine 11 rotates following the assist hydraulic motor 40 to rotate excessively. Therefore, the regeneration valve 22G is closed to stop the assist driving of the assist hydraulic motor 40. This situation is believed to occur, for example, when the swinging of the upper rotating structure 3 ends to free the first and second pumps 14L and 14R of loads so that the engine 11 becomes unloaded. In this case, the engine 11 may rotate to output a torque for idling the first and second pumps 14L and 14R and a torque commensurate to hydraulic pressure loss and mechanical loss, and the output torque of the engine 11 is extremely small. Accordingly, in such a state, there is no need for a large amount of assisting by the assist hydraulic motor 40, and assisting would instead cause over-rotation. Therefore, the assist hydraulic motor 40 is stopped from assisting the engine 11.

In the above-described example, the target torque of the assist hydraulic motor 40 is calculated from the load condition of the engine 11. When the control is that assisting is stopped when the engine 11 is unloaded, the controller 30 may only detect the no-load condition of the engine 11 without determining a target torque. For example, the controller 30 may detect the presence or absence of the operations of all of the levers 26A and 26B, the pedal 26C, etc., and in response to detecting that all of the levers 26A and 26B, the pedal 26C, etc., are returned to their neutral positions, close the regeneration valve 22G to stop the assist driving of the assist hydraulic motor 40.

According to this embodiment, the controller 30 monitors the detected pressure of the swing discharge-side pressure sensor 84. When the detected pressure becomes less than the relief pressure of the discharge-side relief valve 22R or 22L, the controller 30 transmits a control signal to the regeneration valve 22G to close the regeneration valve 22G. This is because a proper brake force for the swing hydraulic motor 21 cannot be obtained when the pressure of hydraulic oil at the discharge-side port 21R or 21L of the swing hydraulic motor 21 is lower than the relief pressure of the relief valve 22R or 22L.

According to this embodiment, the assist hydraulic motor 40 is connected to the output shaft of the engine 11 to constantly rotate. Therefore, as the assist hydraulic motor 40, a hydraulic motor that can idle when there is no supply of hydraulic oil from the swing drive hydraulic circuit 19 (when the regeneration valve 22G is closed) is preferably used.

Furthermore, while the swing discharge-side pressure sensor 84 is provided on the upstream side of the regeneration valve 22G to detect the pressure on the high pressure side of the swing hydraulic motor 21, pressure sensors 84L and 84R may be provided instead of the swing discharge-side pressure sensor 84 to detect the pressure of hydraulic oil on the high pressure side. The pressure sensor 84L is provided near the port 21L of the swing hydraulic motor 21, and detects the pressure on the port 21L side to notify the controller 30 of the pressure. The pressure sensor 84R is provided near the port 21R of the swing hydraulic motor 21, and detects the pressure on the port 21R side to notify the controller 30 of the pressure.

Figure 4:
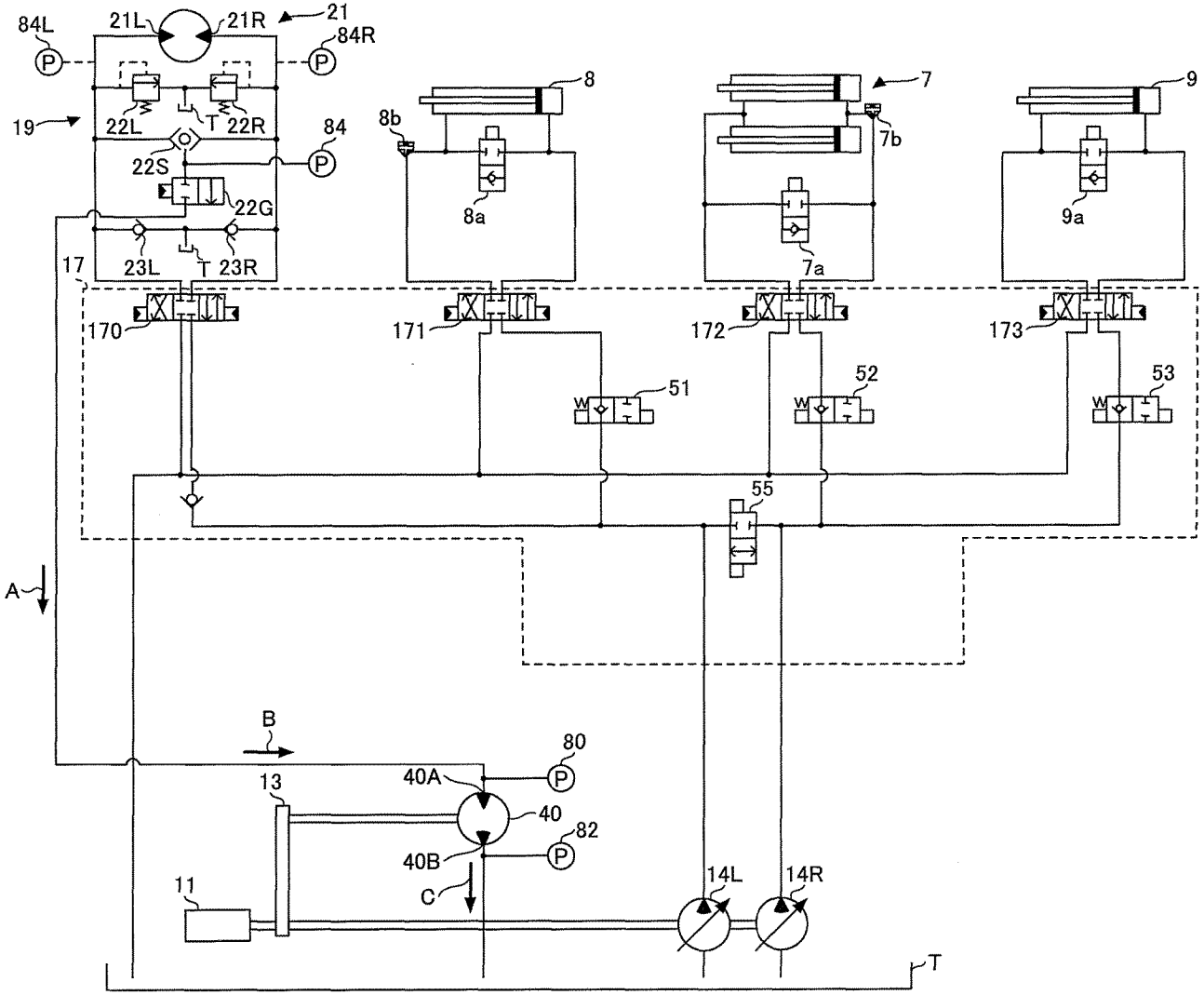
FIG. 4 is a circuit diagram of an all parallel hydraulic circuit.

Next, as another example of a hydraulic circuit according to this embodiment, an all parallel hydraulic circuit is described with reference to FIG. 4. FIG. 4 is a circuit diagram of the all parallel hydraulic circuit. In FIG. 4, parts equivalent to components shown in FIG. 3 are given the same reference numerals, and a description thereof is omitted as appropriate.

According to the all parallel hydraulic circuit shown in FIG. 4, the control valve 17 includes variable load check valves 51 and 52, the variable load check valve 53, a merging valve 55, the flow control valves 170 and 173, and flow control valves 171 and 172.

The flow control valves 170 through 173 are valves that control the direction and flow rate of hydraulic oil flowing into and out of hydraulic actuators. According to this embodiment, each of the flow control valves 170 through 173 is a four-port, three-position spool valve that operates by receiving a pilot pressure generated by the operation apparatus 26 such as the corresponding lever 26A or 26B or pedal 26C at the left or right pilot port. The operation apparatus 26 causes the pilot pressure generated in response to the amount of operation (operation angle) of the lever 26A or 26B, the pedal 26C or the like to act on a pilot port on the side corresponding to the direction of operation.

Specifically, the flow control valve 170 is a spool valve that controls the direction and flow rate of hydraulic oil flowing into and out of the swing drive hydraulic circuit 19 (the swing hydraulic motor 21). The flow control valve 171 is a spool valve that controls the direction and flow rate of hydraulic oil flowing into and out of the arm cylinder 8. The flow control valve 172 is a spool valve that controls the direction and flow rate of hydraulic oil flowing into and out of the boom cylinder 7. The flow control valve 173 is a spool valve that controls the direction and flow rate of hydraulic oil flowing into and out of the bucket cylinder 9.

The variable load check valves 51 through 53 are valves that operate in response to a command from the controller 30. According to this embodiment, the variable load check valves 51 through 53 are two-port, two-position solenoid valves that can switch connection and disconnection between the flow control valves 171 through 173, respectively, and at least one of the first pump 14L and the second pump 14R. The variable load check valves 51 through 53 include a check valve that interrupts the flow of hydraulic oil returning to the pump side at a first position. Specifically, the variable load check valve 51 causes the flow control valve 171 to communicate with at least one of the first pump 14L and the second pump 14R when at the first position, and interrupts the communication when at a second position. The same is the case with the variable load check valve 52 and the variable load check valve 53.

The merging valve 55, which is an example of a merging switching part, is a valve that operates in response to a command from the controller 30. According to this embodiment, the merging valve 55 is a two-port, two-position solenoid valve that can switch to merge or not merge the hydraulic oil discharged by the first pump 14L (first hydraulic oil) with the hydraulic oil discharged by the second pump 14R (second hydraulic oil). Specifically, the merging valve 55 causes the first hydraulic oil and the second hydraulic oil to merge when at a first position, and prevents the first hydraulic oil and the second hydraulic oil from merging when at a second position.

Except the above-described control valve 17, the components of the all parallel hydraulic circuit shown in FIG. 4 and their connections are the same as the components shown in FIG. 3 and their connections, and a description thereof is omitted.

The same as the above-described tandem hydraulic circuit, the all parallel hydraulic circuit as described above also can supply high-pressure hydraulic oil generated at the port 21L or the port 21R at the time of braking the swing hydraulic motor 21 to the assist hydraulic motor 40 to drive the assist hydraulic motor 40. When driving the assist hydraulic motor 40 at the time of decelerating swinging or at the time of stopping swinging, the controller 30 calculates the output torque of the assist hydraulic motor 40 from the differential pressure between the pressure detected by the assist supply-side pressure sensor 80 and the pressure detected by the assist discharge-side pressure sensor 82. When the output torque exceeds the target torque, the controller 30 closes the regeneration valve 22G to interrupt the supply of hydraulic oil to the assist hydraulic motor 40. This prevents the over-rotation of the assist hydraulic motor 40, and as a result, the over-rotation of the engine 11 connected to the assist hydraulic motor 40 can be prevented.

Figure 5:
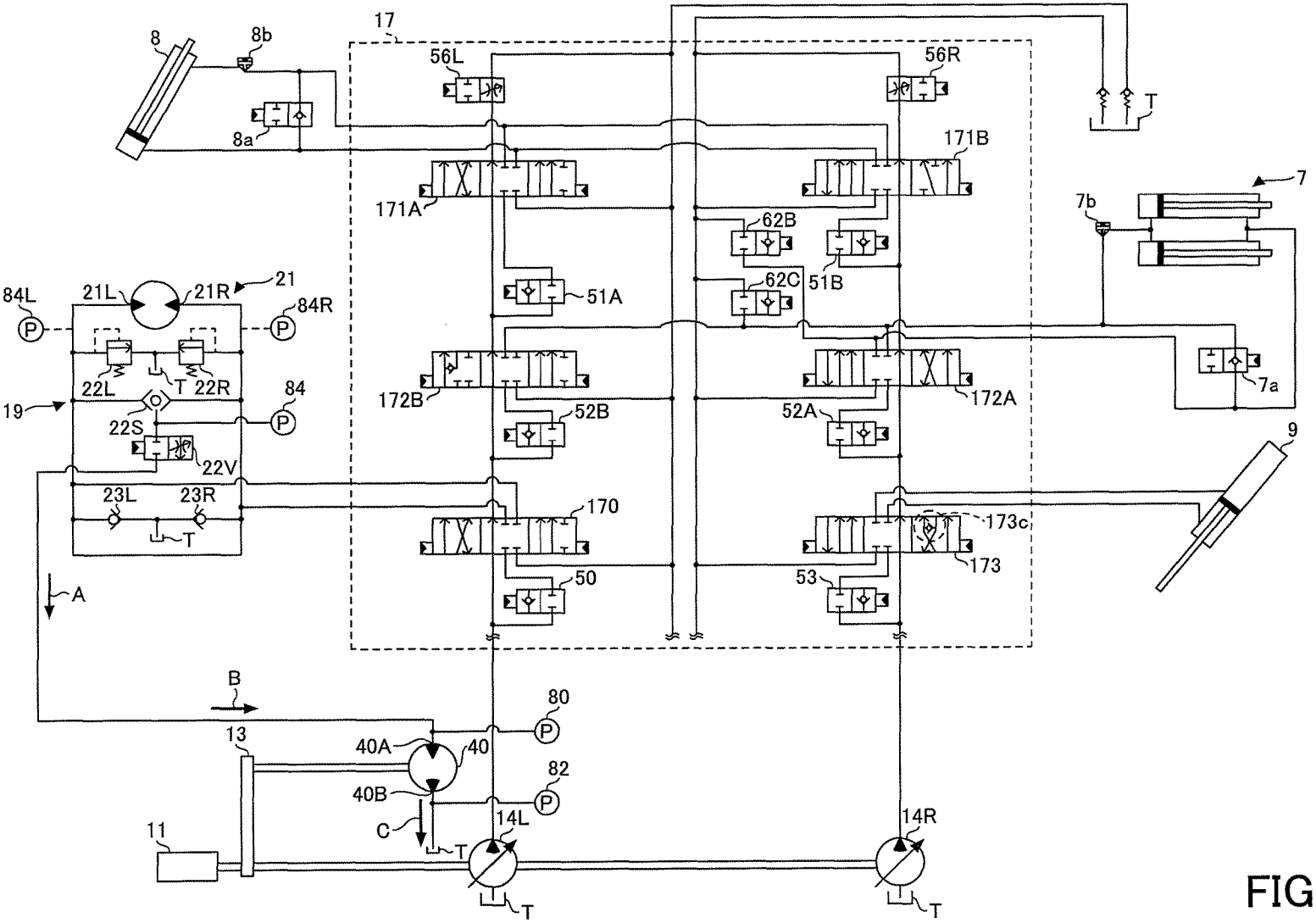
FIG. 5 is a circuit diagram of a tandem hydraulic circuit with a variable opening provided in a path through which hydraulic oil is supplied to an assist hydraulic motor.
Figure 6:
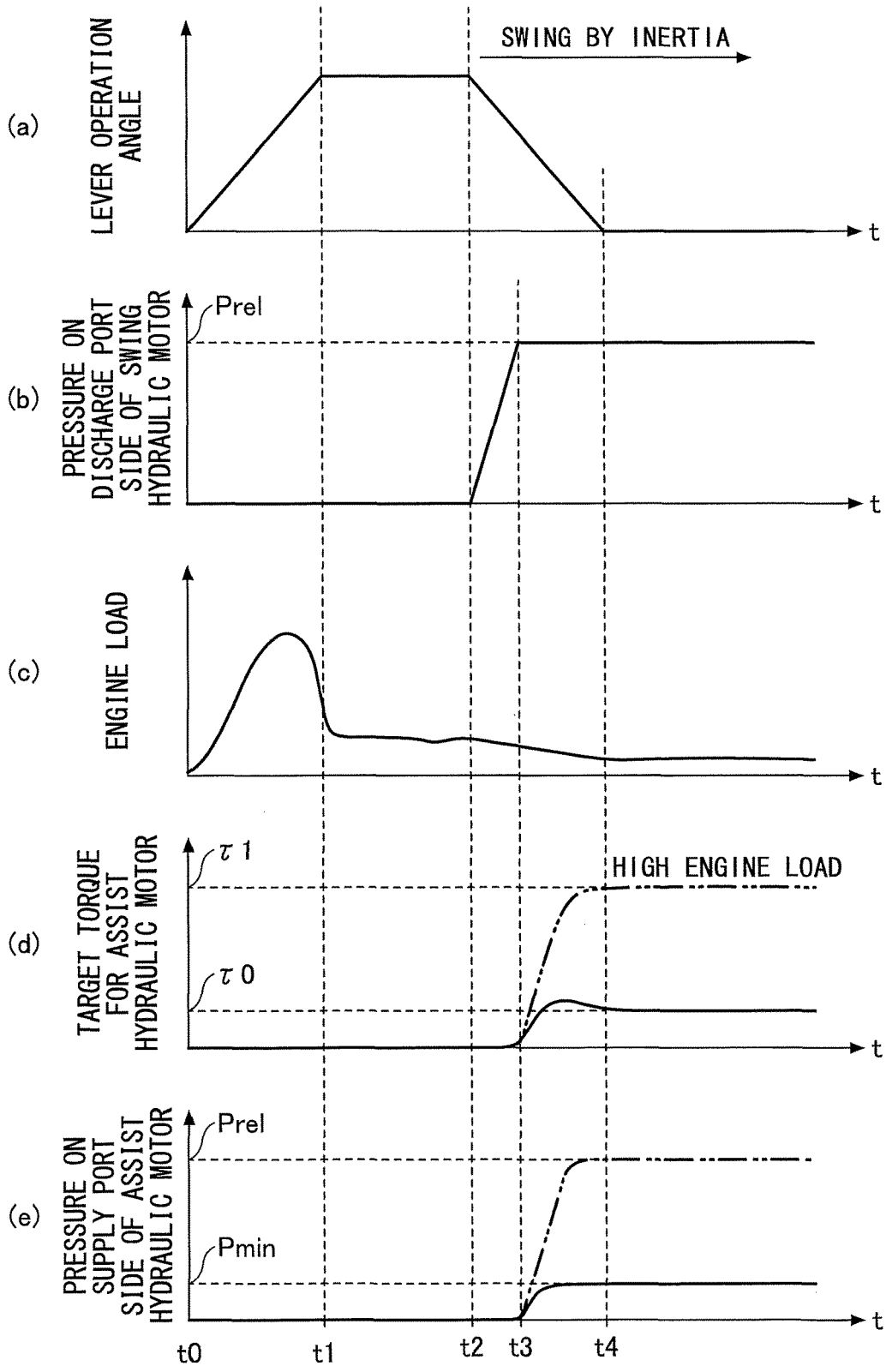
FIG. 6 is a time chart for illustrating the driving of the assist hydraulic motor at the time of a swing stop operation by the hydraulic circuit shown in FIG. 5.

Next, another embodiment is described with reference to FIGS. 5 and 6. FIG. 5 is a circuit diagram of a tandem hydraulic circuit provided with a variable opening. FIG. 6 is a time chart for illustrating the driving of an assist hydraulic motor at the time of a swing stop operation by the hydraulic circuit shown in FIG. 5. In FIG. 5, parts equivalent to components of the tandem hydraulic circuit shown in FIG. 3 are given the same reference numerals, and a description thereof is omitted.

According to the tandem hydraulic circuit shown in FIG. 5, a regeneration valve 22V in which a variable opening is provided is provided instead of the regeneration valve 22G. The variable opening of the regeneration valve 22V is controlled based on the load condition of the engine 11.

Specifically, the same as in the case of the above-described regeneration valve 22G, when the pressure on the discharge port side of the swing drive hydraulic circuit 19 increases after the start of the deceleration of the swing hydraulic motor 21 to reach the relief pressure, the swing discharge-side pressure sensor 84 detects this to transmit a detection signal to the controller 30. In response to the reception of this signal, the controller 30 transmits a control signal to the regeneration valve 22V to open the regeneration valve 22V. As a result, the high-pressure hydraulic oil on the port 21R side passes through the variable opening of the regeneration valve 22V to flow like arrows A and B to be supplied to the supply port 40A of the assist hydraulic motor 40. Accordingly, the assist hydraulic motor 40 is driven with the high-pressure hydraulic oil on the port 21R side generated by the inertial rotation of the swing hydraulic motor 21 to assist the driving of the engine 11.

The hydraulic oil reduced in pressure by driving the assist hydraulic motor 40 is discharged from the discharge port 40B to flow like an arrow C to return to the hydraulic oil tank T.

While the hydraulic oil thus flows from the swing hydraulic motor 21 to the assist hydraulic motor 40 to drive the assist hydraulic motor 40, the controller 30 monitors the load condition of the engine 11. Specifically, the controller 30 estimates the load condition of the engine 11 from, for example, the amount of fuel injection of the engine 11 transmitted from the engine control unit D7. Alternatively, the controller 30 estimates the load condition of the engine 11 from the outputs (discharge pressures and discharge flow rates) of the first and second pumps 14L and 14R.

Then, the controller 30 determines a target torque for the assist hydraulic motor 40 corresponding to the load condition of the engine 11 (which corresponds to the torque of the engine 11). The controller 30 determines the differential pressure between the detected pressure of the assist supply-side pressure sensor 80 and the detected pressure of the assist discharge-side pressure sensor 82. Then, the controller 30 calculates the output torque of the assist hydraulic motor 40 from the determined differential pressure, and compares the calculated output torque with the determined target torque. The output torque may be calculated only from the detected pressure of the assist supply-side pressure sensor 80 when the pressure of the hydraulic oil discharged from the assist hydraulic motor 40 is regarded as equal to atmospheric pressure.

The controller 30 controls the variable opening of the regeneration valve 22V to cause the calculated output torque to be equal to the target torque. That is, when the output torque of the assist hydraulic motor 40 exceeds the target torque, the controller 30 reduces the variable opening of the regeneration valve 22V to decrease the output torque to the target torque to reduce the driving force of the assist operation by the driving of the assist hydraulic motor 40, and continues assisting. As a result, the engine 11 is prevented from rotating excessively and is properly assisted. When the output torque of the assist hydraulic motor 40 is less than or equal to the target torque, the controller 30 increases the variable opening of the regeneration valve 22V to increase the output torque to the target torque, and continues to drive the assist hydraulic motor 40. As a result, the engine 11 can be properly assisted.

Here, the above-described operation is described in more detail with reference to the time chart of FIG. 6.

The following description is given of the case of performing a swing-only operation. The swing-only operation means an operation in the case where only the swing operation lever 26A is operated to perform swinging with the other levers being not operated (being at a neutral position).

As shown in (a) of FIG. 6, it is assumed that the swing operation lever 26A is operated from time to, tilted to the maximum at time t1, kept tilted to the maximum between time t1 and time t2, and returned to a neutral position at time t4 when the swing operation ends.

At time t2, because the swing operation lever 26A is returned toward the neutral position, the swing hydraulic motor 21 is decelerated. As a result, the hydraulic pressure at the discharge-side port (here, the port 21R) of the swing hydraulic motor 21 starts to sharply increase at time t2 as shown in (b) of FIG. 6.

Then, when the hydraulic pressure on the port 21R side reaches the relief pressure of the relief valve 22R at time t3, the regeneration valve 22V opens to let the hydraulic oil at the relief pressure flow toward the supply port 40A of the assist hydraulic motor 40. Accordingly, the pressure on the supply port 40A side of the assist hydraulic motor 40 starts to increase at time t3. As a result, the assist hydraulic motor 40 is driven to assist the driving of the engine 11.

Here, in the case of the swing-only operation, a load on the engine 11 increases from time t0 to be maximized, and thereafter decreases until time t1 as shown in (c) of FIG. 6. From time t1 to time t2, the load is for maintaining the swing speed. The engine load gradually decreases again from time t2, and becomes an idling-time engine load at time t4 when the swing operation lever 26A is returned to the neutral position. After time t4, the load is maintained.

The controller 30 calculates a target torque for the assist hydraulic motor 40 commensurate to the engine load while monitoring the engine load condition shown in (c) of FIG. 6. The calculation of the target torque for the assist hydraulic motor 40 is started at time t3 when the driving of the assist hydraulic motor 40 is started as shown in (d) of FIG. 6.

Here, the example shown in FIG. 6 is the case of the swing-only operation, and the load on the engine 11 decreases after time t3. Then, as indicated by a solid line in (d) of FIG. 6, after time t4, the target torque is a minimum target torque $\tau 0$ solely for maintaining the rotation of the engine 11 and the idling of the first and second pumps 14L and 14R.

Therefore, the controller 30 controls the variable opening of the regeneration valve 22V to cause the hydraulic pressure on the supply port 40A side of the assist hydraulic motor 40 to be a minimum pressure Pmin as shown in (e) of FIG. 6. As a result, even when the engine load is reduced, the assist hydraulic motor 40 (the engine 11) is prevented from rotating excessively, and the engine 11 can be properly assisted. Furthermore, the engine 11 injects fuel for the internal load of the engine 11 itself. Therefore, the assist hydraulic motor 40 can perform engine assisting with respect to the internal load of the engine 11 as well, and can reduce the amount of fuel injection.

In the case of not controlling the hydraulic pressure supplied to the assist hydraulic motor 40 based on the target torque, the output torque $\tau$ of the assist hydraulic motor 40 increases the same as the target torque increases as indicated by a two-dot chain line in (d) of FIG. 6. That is, the output torque $\tau$ becomes a target torque $\tau 1$ that is set when the engine load is high.

Therefore, as indicated by a two-dot chain line in (e) of FIG. 6, the pressure on the supply port 40A side of the assist hydraulic motor 40 increases up to a relief pressure Prel. As a result, the assist hydraulic motor 40 excessively assists the engine 11. Therefore, the controller 30 calculates a target torque for the assist hydraulic motor 40, and controls the pressure of hydraulic oil to the assist hydraulic motor 40 in accordance with the target torque to properly assist the engine 11 while preventing the over-rotation of the assist hydraulic motor 40 (the engine 11).

In the all parallel hydraulic circuit shown in FIG. 4 as well, the regeneration valve 22V in which a variable opening is provided may be provided instead of the regeneration valve 22G.

Figure 7:
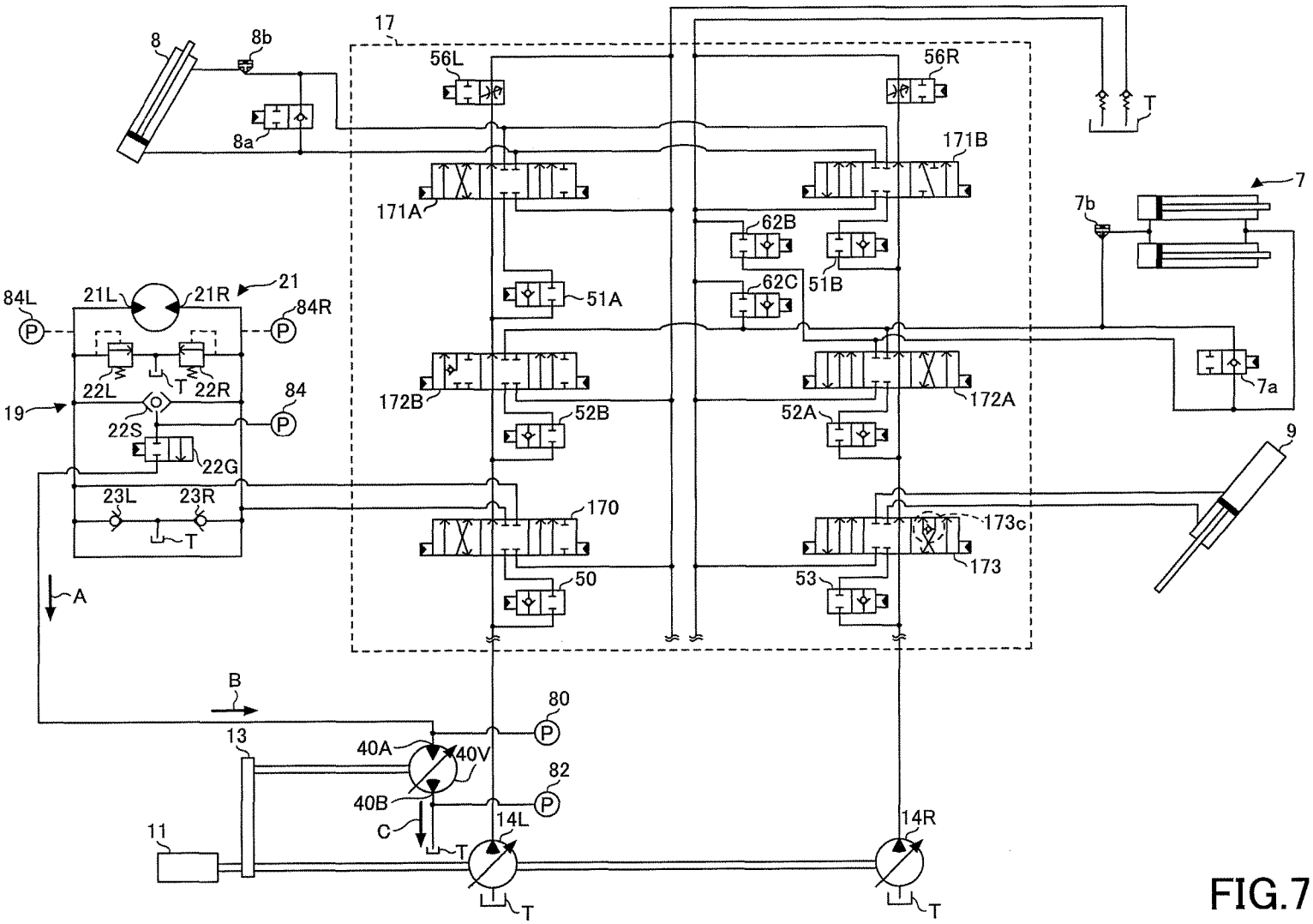
FIG. 7 is a circuit diagram of a tandem hydraulic circuit using a variable displacement hydraulic motor as the assist hydraulic motor.
Figure 8:
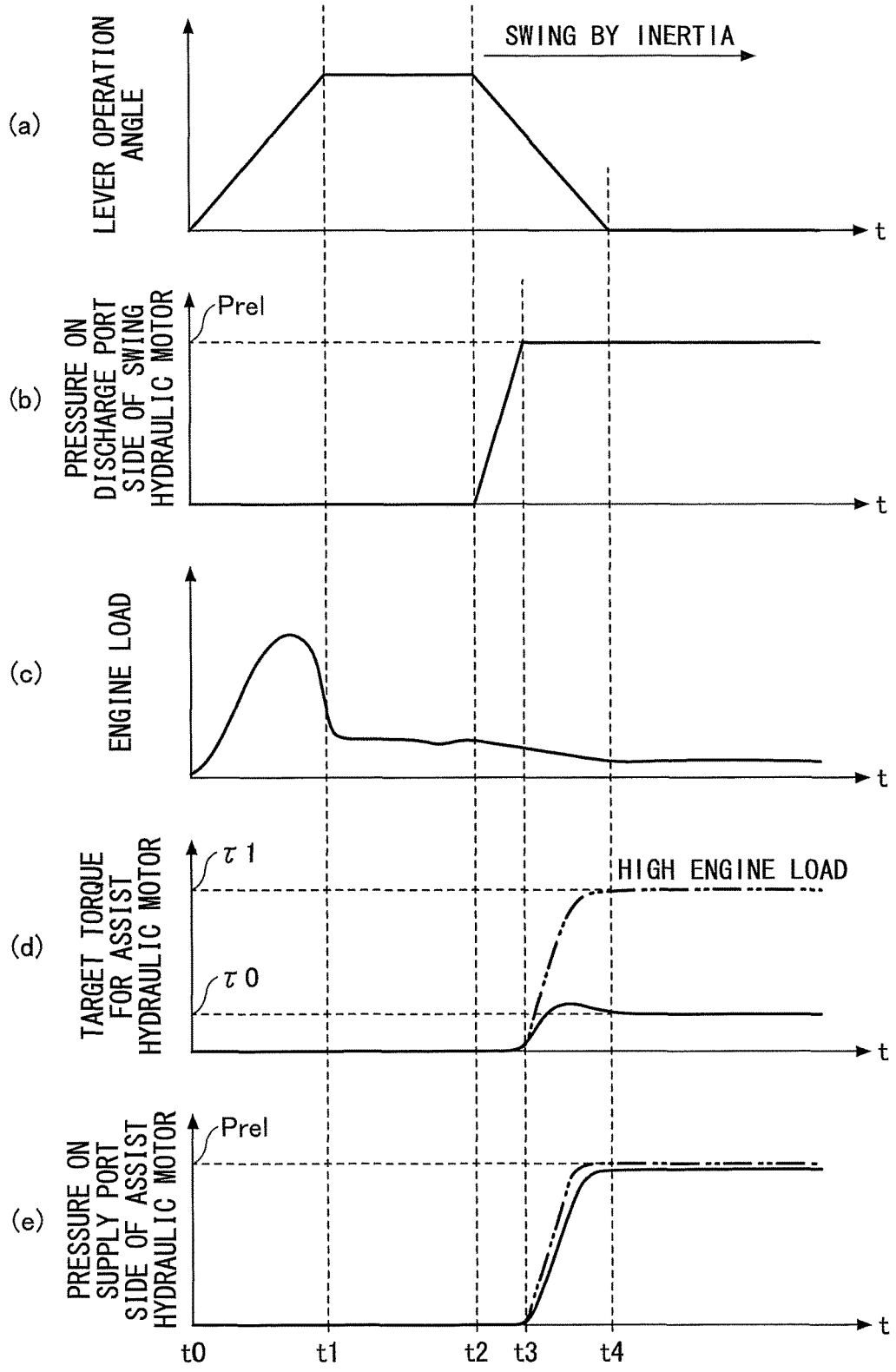
FIG. 8 is a time chart for illustrating the driving of the assist hydraulic motor at the time of a swing stop operation by the hydraulic circuit shown in FIG. 7.

Next, yet another embodiment is described with reference to FIGS. 7 and 8. FIG. 7 is a circuit diagram of a tandem hydraulic circuit using a variable displacement hydraulic motor as an assist hydraulic motor. FIG. 8 is a time chart for illustrating the driving of an assist hydraulic motor at the time of a swing stop operation. In FIG. 7, parts equivalent to components of the tandem hydraulic circuit shown in FIG. 3 are given the same reference numerals, and a description thereof is omitted.

According to the tandem hydraulic circuit shown in FIG. 7, a variable displacement hydraulic motor 40V is used as the assist hydraulic motor 40. The output of the variable displacement hydraulic motor 40V is controlled based on a load on the engine 11.

According to the tandem hydraulic circuit shown in FIG. 7, as the assist hydraulic motor 40, a variable displacement hydraulic motor is used instead of a fixed displacement hydraulic motor. The output of the variable displacement hydraulic motor can be controlled by a control signal from the controller 30. For example, in the case where a swash-plate variable displacement hydraulic motor is used as the assist hydraulic motor 40, the controller 30 controls the swash plate tilt angle in accordance with a load on the engine 11, thereby controlling the output of the assist hydraulic motor 40 to prevent the over-rotation of the assist hydraulic motor 40 (the engine 11).

Specifically, the same as in the case of the above-described regeneration valve 22G, when the pressure on the discharge port side of the swing drive hydraulic circuit 19 increases after the start of the deceleration of the swing hydraulic motor 21 to reach the relief pressure, the swing discharge-side pressure sensor 84 detects this to transmit a detection signal to the controller 30. In response to the reception of this signal, the controller 30 transmits a control signal to the regeneration valve 22G to open the regeneration valve 22G. As a result, the high-pressure hydraulic oil on the port 21R side passes through the regeneration valve 22G to flow like arrows A and B to be supplied to the supply port 40A of the assist hydraulic motor 40. Accordingly, the assist hydraulic motor 40 is driven with the high-pressure hydraulic oil on the port 21R side generated by the inertial rotation of the swing hydraulic motor 21 to assist the driving of the engine 11.

The hydraulic oil reduced in pressure by driving the assist hydraulic motor 40 is discharged from the discharge port 40B to flow like an arrow C to return to the hydraulic oil tank T.

While the hydraulic oil thus flows from the swing hydraulic motor 21 to the assist hydraulic motor 40 to drive the assist hydraulic motor 40, the controller 30 monitors the load condition of the engine 11. Specifically, the controller 30 estimates the load condition of the engine 11 from, for example, the amount of fuel injection of the engine 11 transmitted from the engine control unit D7. Alternatively, the controller 30 estimates the load condition of the engine 11 from the outputs (discharge pressures and discharge flow rates) of the first and second pumps 14L and 14R.

Then, the controller 30 determines a target torque for the assist hydraulic motor 40 corresponding to the load condition of the engine 11 (which corresponds to the torque of the engine 11). The controller 30 determines the differential pressure between the detected pressure of the assist supply-side pressure sensor 80 and the detected pressure of the assist discharge-side pressure sensor 82. Then, the controller 30 calculates the output torque of the assist hydraulic motor 40 from the determined differential pressure, and compares the calculated output torque with the determined target torque. The output torque may be calculated only from the detected pressure of the assist supply-side pressure sensor 80 when the pressure of the hydraulic oil discharged from the assist hydraulic motor 40 is regarded as equal to atmospheric pressure.

The controller 30 controls the output of the assist hydraulic motor 40 to cause the calculated output torque to be equal to the target torque. Specifically, when a swash-plate variable displacement hydraulic motor is used as the assist hydraulic motor 40, the controller 30 controls the tilt angle of the swash plate of the assist hydraulic motor 40 to cause the calculated output torque to be equal to the target torque. That is, when the output torque of the assist hydraulic motor 40 exceeds the target torque, the controller 30 reduces the tilt angle of the assist hydraulic motor 40 to decrease the output torque to the target torque, and continues assisting by the driving of the assist hydraulic motor 40. As a result, the engine 11 is prevented from rotating excessively and is properly assisted. When the output torque of the assist hydraulic motor 40 is less than or equal to the target torque, the controller 30 increases the tilt angle of the assist hydraulic motor 40 to increase the output torque to the target torque, and continues to drive the assist hydraulic motor 40. As a result, the engine 11 can be properly assisted.

Here, the above-described operation is described in more detail with reference to the time chart of FIG. 8.

The following description is given of the case of performing a swing-only operation. The swing-only operation means an operation in the case where only the swing operation lever 26A is operated to perform swinging with the other levers being not operated (being at a neutral position).

As shown in (a) of FIG. 8, it is assumed that the swing operation lever 26A is operated from time t0, tilted to the maximum at time t1, kept tilted to the maximum between time t1 and time t2, and returned to a neutral position at time t4 when the swing operation ends.

At time t2, because the swing operation lever 26A is returned toward the neutral position, the swing hydraulic motor 21 is decelerated. As a result, the hydraulic pressure at the discharge-side port (here, the port 21R) of the swing hydraulic motor 21 starts to sharply increase at time t2 as shown in (b) of FIG. 8. Then, when the hydraulic pressure on the port 21R side reaches the relief pressure Prel of the relief valve 22R at time t3, the regeneration valve 22G opens to let the hydraulic oil at the relief pressure flow toward the supply port 40A of the assist hydraulic motor 40. Accordingly, the pressure on the supply port 40A side of the assist hydraulic motor 40 starts to increase at time t3 as shown in (e) of FIG. 8. As a result, the assist hydraulic motor 40 is driven to assist the driving of the engine 11. Hydraulic oil is supplied from the main pump 14 to the intake-side port of the swing hydraulic motor 21 when the swing hydraulic motor 21 is decelerated.

Here, in the case of the swing-only operation, a load on the engine 11 increases from time t0 to be maximized, and thereafter decreases until time t1 as shown in (c) of FIG. 8.

From time t1 to time t2, the load is for maintaining the swing speed. The engine load gradually decreases again from time t2, and becomes an idling-time engine load at time t4 when the swing operation lever 26A is returned to the neutral position. After time t4, the load is maintained.

The controller 30 calculates a target torque for the assist hydraulic motor 40 commensurate to the engine load while monitoring the engine load condition shown in (c) of FIG. 8. The calculation of the target torque for the assist hydraulic motor 40 is started at time t3 when the driving of the assist hydraulic motor 40 is started as shown in (d) of FIG. 8.

Here, the example shown in FIG. 8 is the case of the swing-only operation, and the load on the engine 11 decreases after time t3. Then, as indicated by a solid line in (d) of FIG. 8, after time t4, the target torque is a minimum target torque τ0 solely for maintaining the rotation of the engine 11 and the idling of the first and second pumps 14L and 14R.

The pressure of the hydraulic oil supplied to the assist hydraulic motor 40, however, sharply increases from time t3 to reach the relief pressure Prel as shown in (e) of FIG. 8. Accordingly, although the hydraulic oil at the relief pressure is supplied to the assist hydraulic motor 40, the controller 30 controls the swash plate to cause the output of the assist hydraulic motor 40 to be equal to the target torque τ0 indicated by a solid line in (d) of FIG. 8, thereby controlling the output of the assist hydraulic motor 40. As a result, even when the engine load is reduced, the assist hydraulic motor 40 (the engine 11) is prevented from rotating excessively, and the engine 11 can be properly assisted.

In the case of not controlling the hydraulic pressure supplied to the assist hydraulic motor 40 based on the target torque, the output torque τ of the assist hydraulic motor 40 would increase the same as the target torque increases as indicated by a two-dot chain line in (d) of FIG. 8. That is, the output torque τ would become a target torque τ1 that is set when the engine load is high (when the hydraulic oil at the relief pressure Prel is supplied). In this case, the assist hydraulic motor 40 would excessively assist the engine 11. Therefore, the controller 30 controls the pressure of hydraulic oil of the assist hydraulic motor 40 in accordance with the engine load, thereby properly assisting the engine 11 while preventing the over-rotation of the assist hydraulic motor 40 (the engine 11).

In the all parallel hydraulic circuit shown in FIG. 4 as well, a variable displacement hydraulic motor may be used as the assist hydraulic motor 40.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. A shovel has been described based on embodiments of the present invention. It should be understood, however, that various changes, substitutions, and alterations could be made hereto without departing from the spirit and scope of the invention.

What is claimed is:

1. A shovel, comprising:
a hydraulic pump configured to be driven by the engine;
a swing hydraulic motor configured to swing a rotating structure with high-pressure hydraulic oil supplied from the hydraulic pump;
a swing drive hydraulic circuit configured to drive the swing hydraulic motor;
an assist hydraulic motor connected to the engine and configured to be supplied with hydraulic oil discharged from the swing drive hydraulic circuit; and
a controller configured to control driving of the shovel,
wherein the controller is configured to detect a load condition of the engine, and control a supply of the hydraulic oil to the assist hydraulic motor at a time of deceleration of the swing hydraulic motor, based on the detected load condition.

2. The shovel as claimed in claim 1, wherein the controller is configured to determine a target torque for the assist hydraulic motor based on the detected load condition of the engine.

3. The shovel as claimed in claim 2, wherein the controller is configured to set the target torque for the assist hydraulic motor to a torque that does not assist driving of the engine, when a load on the engine is less than a predetermined value.

4. The shovel as claimed in claim 3, wherein the torque that does not assist the driving of the engine is a torque that maintains idling of the engine.

5. The shovel as claimed in claim 2, further comprising:
a pressure sensor provided on an upstream side of the assist hydraulic motor,
wherein the controller is configured to
calculate an output torque of the assist hydraulic motor based on a detection value of the pressure sensor; and
control the supply of the hydraulic oil to the assist hydraulic motor to cause the calculated output torque to be the target torque.

6. The shovel as claimed in claim 5, wherein the pressure sensor is provided on a port of the swing hydraulic motor from which the hydraulic oil is discharged.

7. The shovel as claimed in claim 2, further comprising:
a variable opening provided between the assist hydraulic motor and the swing drive hydraulic circuit,
wherein the controller is configured to control the variable opening based on the target torque.

8. The shovel as claimed in claim 2, wherein
the assist hydraulic motor is a variable displacement hydraulic motor, and
the controller is configured to control an output of the variable displacement hydraulic motor based on the target torque.

9. The shovel as claimed in claim 1,
wherein
the hydraulic pump is configured to supply the high-pressure hydraulic oil to an intake side of the swing hydraulic motor at the time of the deceleration of the swing hydraulic motor.

10. A method of driving a shovel, the shovel including a hydraulic pump configured to be driven by the engine, a swing hydraulic motor configured to swing a rotating structure with high-pressure hydraulic oil supplied from the hydraulic pump, a swing drive hydraulic circuit configured to drive the swing hydraulic motor, an assist hydraulic motor connected to the engine and configured to be supplied with hydraulic oil discharged from the swing drive hydraulic circuit, and a controller configured to control driving of the shovel, the method comprising:
detecting a load condition of the engine; and
controlling a supply of the hydraulic oil to the assist hydraulic motor at a time of deceleration of the swing hydraulic motor, based on the detected load condition.

11. The method of driving the shovel as claimed in claim 10, further comprising:

determining a target torque for the assist hydraulic motor based on the detected load condition of the engine, wherein the supply of the hydraulic oil is controlled based on the determined target torque.

* * * * *